United States Patent [19]

Rose

[11] Patent Number: 4,648,144

[45] Date of Patent: Mar. 10, 1987

[54] BRACKET FOR SUPPORTING TRACTION WEIGHTS

[76] Inventor: Richard Rose, P.O. Box 66973-158, Houston, Tex. 77006

[21] Appl. No.: 745,141

[22] Filed: Jun. 17, 1985

[51] Int. Cl.[4] ..... A47C 21/00

[52] U.S. Cl. ..... 5/503; 5/508; 248/214

[58] Field of Search ..... 5/445, 503, 504, 508; 128/31, 75; 248/214, 215, 300

[56] References Cited

U.S. PATENT DOCUMENTS

| | | | |
|---|---|---|---|
| 373,472 | 11/1887 | Moser | 248/214 |
| 795,705 | 7/1905 | Jones | 248/300 |
| 1,565,191 | 12/1925 | Nelson | 248/214 |
| 1,906,369 | 5/1933 | Christie | 248/227 |
| 2,425,629 | 8/1947 | Mayer | 224/452 |
| 2,659,491 | 11/1953 | Williams | 248/214 |
| 2,832,377 | 4/1958 | Kingsley | 140/93 C |
| 2,909,175 | 10/1959 | Kinnear | 128/84 R |
| 3,166,863 | 1/1965 | Gray | 248/300 |
| 3,337,880 | 8/1967 | Florek | 5/503 |
| 4,203,175 | 5/1980 | Heine | 5/503 |
| 4,431,154 | 2/1984 | Hamm | 248/215 |
| 4,566,666 | 1/1986 | Meska et al. | 248/558 |

FOREIGN PATENT DOCUMENTS

| | | | |
|---|---|---|---|
| 73084 | 9/1960 | France | 5/504 |

*Primary Examiner*—John E. Murtagh
*Assistant Examiner*—Andrew Joseph Rudy
*Attorney, Agent, or Firm*—Neal J. Mosely

[57] ABSTRACT

A bracket for use on hospital beds for supporting orthopedic traction weights comprises a pair of parallel laterally spaced hook elements adapted to removably engage the foot board of the bed and a horizontal element secured to the lower ends thereof and which has outwardly extending opposed ends each of which is provided with an arcuate weight receiving notch to receive the hook portion of an orthopedic traction weight and support the traction weights thereon.

6 Claims, 3 Drawing Figures

BRACKET FOR SUPPORTING TRACTION WEIGHTS

BACKGROUND OF THE INVENTION

1. Field of the Invention

This invention relates generally to support brackets, and more particularly to a bracket for use on hospital beds for supporting orthopedic traction weights.

2. Brief Description of the Prior Art

Generally, when a patient requires orthopedic correction of a nature in which it is necessary to place certain parts of the body in traction, it is required that tensioning devices be used. The conventional method for applying traction is to attach to the patients bed frame a tensioning frame which carries a set of pulleys and cables. Traction weights are attached to the end of the cables.

For various reasons, it is often necessary to relieve the tension which requires that the weights be lifted and supported by some means. Some hospital proceedures call for periodically applying tension and then relieving the tension for a period of time. It is also necessary to support the weights in some manner in the event that it is desired to raise or lower the patients bed or the patients position on the bed.

A conventional method consists of a hospital attendant entering the patients room at the appropriate time and moving a chair or other piece of furniture which may be handy near the patients bed and physically lifting the weights onto the chair or other piece of furniture. This not only involves considerable work by hospital personnel, but takes up considerable floor space and presents a safety hazard in a crowded hospital or sick room, particularly in the case of nurses and attendants who must be continually moving around the patients bed.

There are several patients which disclose various brackets, holders, and traction frames.

Heine, U.S. Pat. No. 4,203,175 discloses a slipper holder which is designed to be received on the side rail of a hospital bed. The holder includes a body having a single upper hook portion engageable with the upper rail and a V-shaped depending portion which is engageable with the lower rail. The patient's slippers are supported on a pair of side-by-side upwardly extending finger portions formed on the body of the holder. The hook and upwardly extending finger construction of the holder would not be suitable for receiving and supporting conventional traction weights.

Mayer, U.S. Pat. No. 2,425,629 discloses a luggage carrier comprising a curved hook element adapted to engage over the window sill of a vehicle, a vertical depending portion having a cross element affixed to the bottom thereof for bearing against the side of a vehicle, an element extending outwardly obliquely upward therefrom, and a U-shaped element connecting the oblique element with the depending portion. The carriers are used in pairs for supporting articles on the side of a vehicle. The curved hook and U-shaped elements of the carrier would not be suitable for receiving and supporting conventional traction weights.

Christie, U.S. Pat. No. 1,906,369 discloses a tubular support adapted to be attached to a hospital bed and support a liquid container above a bed patient. The support has an adjustable stand which may be adjusted to vary the height of the container above the bed. The support construction of this patent could not be used for supporting conventional traction weights.

Kitchin, U.S. Pat. No. 2,832,377 discloses an adjustable traction frame for supporting a plurality of weight and pulley traction devices. The frame is attached to the bedstead and used for adjusting all of the traction devices simultaneously in accordance with the position of the patient or the height of the bed.

Kinnear, U.S. Pat. No. 2,909,175 discloses a surgical traction frame suspended on a hospital bed frame which includes an elongated roller over which a traction cord travels. The roller permits the traction cord to slide laterally when the patient shifts his position to maintain the traction weight in proper alignment with the patient's leg.

The frames of Kitchin and Kinnear replace the conventional pulley arrangement used in traction proceedures, and the bracket in accordance with the present invention may be used in cooperation with them.

The prior art in general, and these patents in particular do not disclose individually or in combination the present bracket for use on hospital beds for supporting orthopedic traction weights comprising a pair of parallel laterally spaced hook elements adapted to removably engage the foot board of the bed and a horizontal element secured to the lower ends thereof and which has outwardly extendingopposed ends each of which is provided with an arcuate weight receiving notch to receive the hook portion of an orthopedic traction weight and support the traction weights thereon.

SUMMARY OF THE INVENTION

It is therefore an object of the present invention to provide a bracket for supporting orthopedic traction weights which requires no floor space.

It is another object of this invention to provide a bracket for supporting bracket for supporting orthopedic traction weights which is easily received on the foot board of conventional hospital beds without marring the surface thereof.

Another object of this invention is to provide a bracket for supporting orthopedic traction weights which is simply and economically constructed, and rugged and durable in use.

Another object of this invention is to provide a bracket for supporting orthopedic traction weights on which the weights are stored safely without the risk of being accidently knocked over or dropped.

Other objects of the invention will become apparent from time to time throughout the specification and claims as hereinafter related.

The above noted objects and other objects of the invention are accomplished by a bracket for use in hospital beds for supporting orthopedic traction weights comprises a pair of parallel laterally spaced hook elements adapted to removably engage the foot board of the bed and a horizontal element secured to the lower ends thereof and which has outwardly extending opposed ends each of which is provided with an arcuate weight receiving notch to receive the hook portion of an orthopedic traction weight and support the traction weights thereon.

DESCRIPTION OF THE PREFERRED EMBODIMENT

Figure 1:
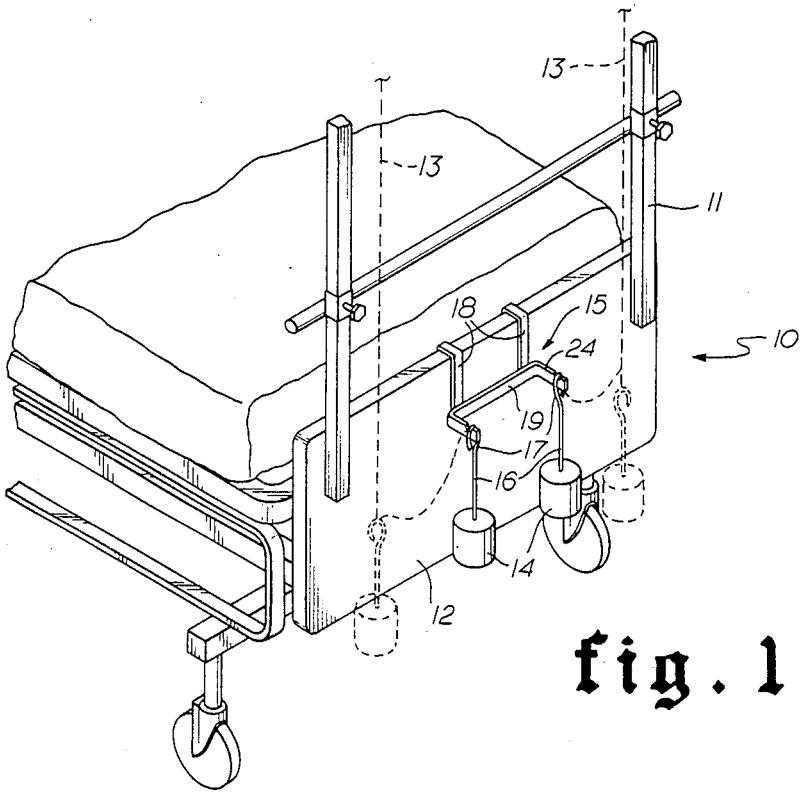
FIG. 1 is an isometric view of a conventional hospital bed having the bracket for supporting orthopedic traction weights installed thereon.
Figure 2:
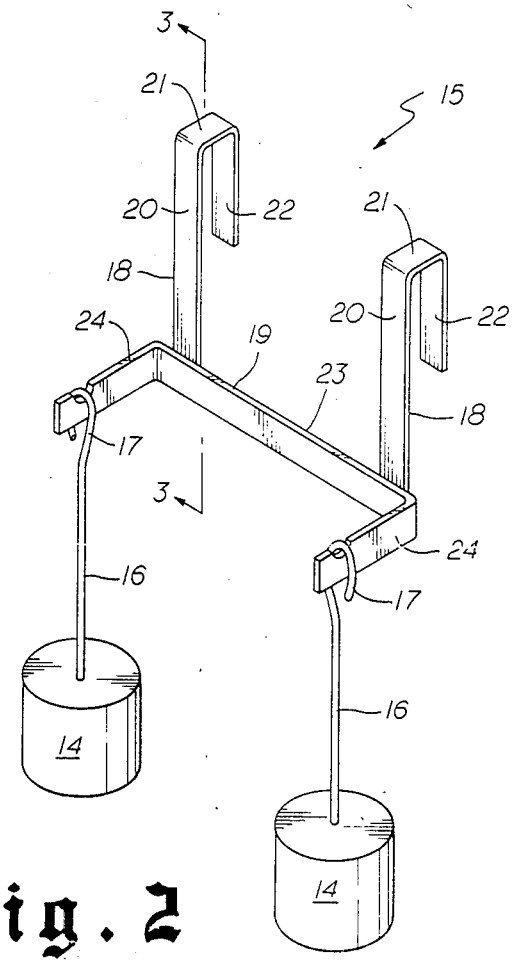
FIG. 2 is an isometric view of the bracket in accordance with the present invention shown supporting a pair of orthopedic traction weights.

Referring to the drawings by numerals of reference, and particularly to FIG. 1, there is shown a hospital bed 10 having an orthopedic traction frame 11 attached to the foot board 12. The traction frame 11 carries a set of pulleys (not shown) over which cables 13 ride. Each cable 13 has one end attached to the appropriate limb of the patient and the other end attached to a tensioning weight 14. The foot board 12 of a conventional hospital bed comprises a generally rectangular panel.

A preferred bracket 15 for suspending orthopedic traction weights is shown installed on the foot board 12 of the conventional hospital bed 10. Conventional tensioning weights 14 are installed about a rod-like brace 16 which has a hooked or looped end 17 extending above the weight for receiving one end of the cable. As indicated in dotted line, the tensioning weights hang vertically at the foot of the bed from the pulleys when traction is being applied.

The preferred bracket 15 comprises pair of parallel, laterally spaced hook members 18 secured to a horizontal support member 19 by suitable means such as welding. The hook members and the support member are formed of flat rectangular stainless steel bar, however any other suitable material such as rod or tubing could be used. Each hook member 18 has an elongated vertical porton 20 secured at its lower end to the support member 19 to extend upwardly therefrom, a horizontal portion 21 at the upper end terminating in a relatively short rebent vertical portion 22.

The hooks formed by vertical portions 20 and rebent portions 22 are spaced apart sufficiently to be received over the top of the conventional foot board 12. It should be understood that the bracket could also be installed over foot boards of tubular construction.

The horizontal support member 19 has a center portion 23 which extends transversely between the bottom of the hook members 18, and each opposed end extends perpendicularly outward forming parallel support arms 24. The support arms 24 are provided with an arcuate slot or notch 25 near their terminal end.

Figure 3:
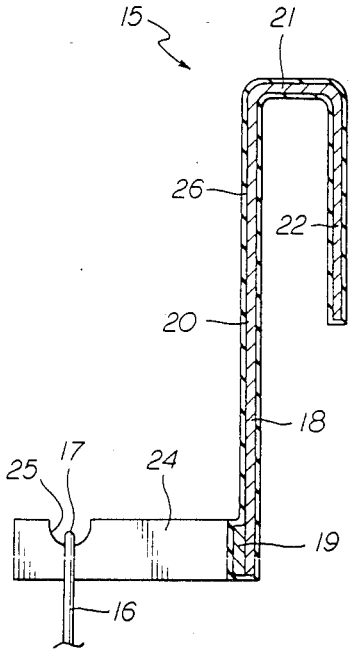
FIG. 3 side elevational view in longitudinal cross section taken along line 3—3 of FIG. 2.

As shown in FIG. 3, a suitable protective coating 26 such as rubber, latex, or preferrably epoxy is applied to the bracket 15 by suitable methods such as dipping or spraying. The coating provides a soft cushion to prevent the bracket from damage the surface of the foot board and also provides corrosion resistance for the bracket material.

OPERATION

When a patient requires orthopedic correction of a nature in which it is necessary to place certain parts of the body in traction, the conventional tensioning devices are installed on the frame of the bed, such as on the foot board as shown in FIG. 1. The cables are attached to the patient's body part, or appropriate appliance, and to the traction weights.

The bracket is easily installed on the foot board by placing the hook members over the top of the foot board with the support arms extending outward from the bed. When it is desired to relieve the tension, raise or lower the bed, or change the patients position on the bed, the weights are simply lifted and the hooks thereof placed in the notch of the support arms. In this manner, the tension is relieved in the cable and the weights are suspended thereon to be safely supported compactly against the bed frame. No floor space is required for a supporting structure to present a safety hazard for nurses and attendants who must be continually working around the patients bed.

While this invention has been described fully and completely with special emphasis upon a preferred embodiment, it should be understood that within the scope of the appended claims the invention may be practiced otherwise than as specifically described herein.

I claim:

1. A bracket for installation on the foot board of hospital beds for supporting orthopedic traction weights comprising a pair of parallel laterally spaced hook elements, each having a first elongated vertical portion, a horizontal portion extending outwardly perpendicular thereto at the top end thereof, and a second vertical portion depending from the horizontal portion parallel to the first vertical portion and spaced therefrom sufficient to slidably engage the top portion the hospital bed foot board, a horizontal element secured to the bottom of each said hook element first vertical portion to extend transversely therebetween and having opposed ends which extend perpendicularly outward therefrom, and an arcuate notch formed in the top surface of the outwardly extended ends of said horizontal element to removably receive the hook portion of an orthopedic traction weight and support said traction weight thereon.

2. A bracket according to claim 1 wherein said bracket is coated with a protective resilient material to prevent corrosion, damage to the surface of the foot board, and accidental displacement of the bracket.

3. A bracket according to claim 1 wherein said hook elements and said horizontal element are of stainless steel, and said horizontal element secured to the bottom of each said hook element first vertical portion by welding.

4. In combination with a hospital bed having a foot board, a bracket for supporting orthopedic traction weights comprising a pair of parallel laterally spaced hook elements, each having a first elongated vertical portion, a horizontal portion extending outwardly perpendicular thereto at the top end thereof, and a second vertical portion depending from the horizontal portion parallel to the first vertical portion and spaced therefrom sufficient to slidably engage the top portion the hospital bed foot board, a horizontal element secured to the bottom of each said hook element first vertical portion to extend transversely therebetween and having opposed ends which extend perpendicularly outward therefrom, and an arcuate notch formed in the top surface of the outwardly extended ends of said horizontal element to removably receive the hook porton of an orthopedic traction weight and support said traction weight thereon.

5. The combination according to claim 4 wherein said bracket is coated with a protective resilient material to prevent corrosion, damage to the surface of the foot board, and accidental displacement of the bracket.

6. The combination according to claim 4 wherein said hook elements and said horizontal element are of stainless steel, and said horizontal element secured to the bottom of each said hook element first vertical portion by welding.

* * * * *